United States Patent [19]

Dudley

[11] Patent Number: 4,766,734

[45] Date of Patent: Aug. 30, 1988

[54] HEAT PUMP SYSTEM WITH HOT WATER DEFROST

[75] Inventor: Kevin F. Dudley, Cazenovia, N.Y.

[73] Assignee: Electric Power Research Institute, Inc., Palo Alto, Calif.

[21] Appl. No.: 94,266

[22] Filed: Sep. 8, 1987

[51] Int. Cl.[4] ..... F25B 13/00

[52] U.S. Cl. ..... 62/160; 62/238.6; 62/238.7; 62/278

[58] Field of Search ..... 62/79, 80, 81, 82, 278, 62/238.6, 238.7, 160

[56] References Cited

U.S. PATENT DOCUMENTS

| | | | |
|---|---|---|---|
| 4,158,950 | 6/1979 | McCarty | 62/278 |
| 4,399,664 | 8/1983 | Derosier | 62/238.6 X |
| 4,493,193 | 1/1985 | Fisher | 62/238.6 X |
| 4,598,557 | 7/1986 | Robinson et al. | 62/238.6 |
| 4,625,524 | 12/1986 | Kimura et al. | 62/278 |
| 4,646,537 | 3/1987 | Crawford | 62/238.6 |

*Primary Examiner*—Lloyd L. King

*Attorney, Agent, or Firm*—Wall and Roehrig

[57] ABSTRACT

An integrated heat pump and hot water system including a water to refrigerant heat exchanger having a refrigerant evaporating circuit and a refrigerant condensing circuit that are in heat transfer relation with the water circuit. A bi-flow expansion valve with a positive shut off feature is mounted in the refrigerant liquid line connecting the indoor and outdoor coil of the heat pump. The refrigerant evaporator circuit is connected between the inlet of the compressor and the liquid line by an evaporator line that enters the liquid line between the bi-flow expansion valve and the outdoor coil. A solenoid actuated metering valve is placed in the evaporator line to control the flow of refrigerant passing through the evaporator circuit. The condensing circuit of the heat exchanger is connected directly to the discharge line of the compressor so that the refrigerant discharged from the compressor passes through the condensing circuit. By simply cycling the expansion valve and the metering valve a number of operational modes may be selected whether or not the heat pump is conditioning comfort zone air.

6 Claims, 1 Drawing Sheet

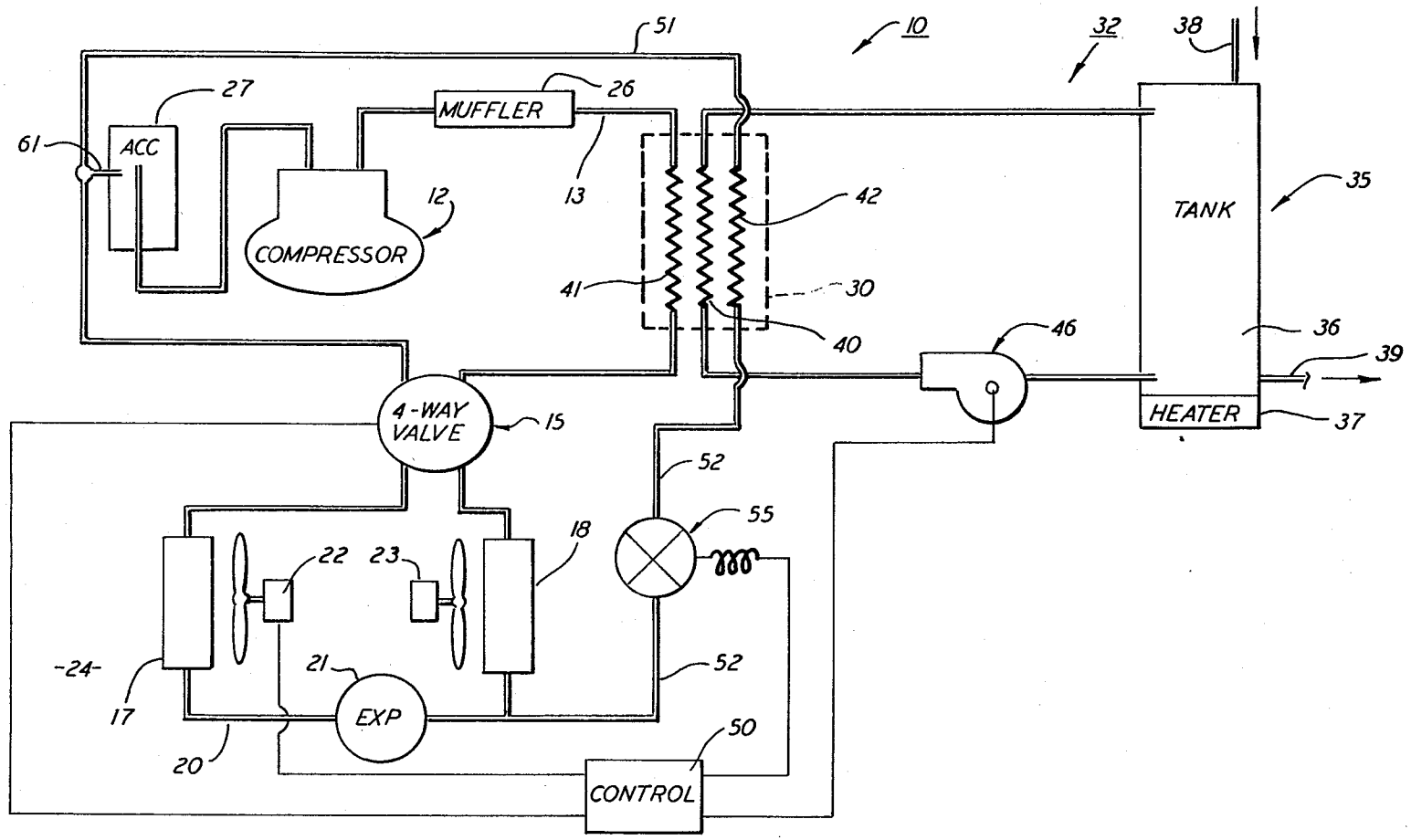
TANK
HEATER
MUFFLER
COMPRESSOR
ACC
4-WAY VALVE
EXP
CONTROL
35
36
37
38
39
32
46
10
42
30
40
41
51
26
13
12
27
61
15
18
23
22
21
20
17
-24-
52
55
50

HEAT PUMP SYSTEM WITH HOT WATER DEFROST

BACKGROUND OF THE INVENTION

This invention relates to an improved heat pump that is integrated with a domestic hot water system to provide six separate modes of operation utilizing a minimum amount of additional equipment.

Integrated heat pump systems of this type have been used for some time to heat domestic hot water. Typically, in the earlier systems, superheated refrigerant vapors leaving the discharge end of the heat pump compressor are brought into heat transfer relation with a flow of water within a desuperheater. A portion of the energy in the refrigerant is rejected into the water thereby raising the temperature of the water. The amount of water heating provided by this type of system is limited and water heating cannot be accomplished unless the heat pump is delivering heating or cooling to a comfort region.

Robinson in U.S. Pat. No. 4,598,557 discloses an improved integrated heat pump system having a refrigerant to water heat exchanger for heat flow of water passing therethrough. Through use of a rather complex valve and piping network the vapor fan coil of the heat pump can be removed from the refrigerant flow circuit and the water to refrigerant heat exchanger selectively adapted to carry the entire condensing load. As a result, hot water can be generated when the system is not called upon to deliver either heating or cooling to the indoor comfort zone. The independent hot water mode of operation provided by Robinson represents an important step forward in the art.

Recently, U.S. Pat. No. 4,646,537 issued to Crawford describing an integrated heat pump that is capable of delivering six separate modes of operation. These include comfort zone heating and cooling with or without domestic hot water heating, hot water heating without comfort zone heating or cooling, and lastly a defrost mode in which the outdoor heat exchanger is defrosted using energy stored in the hot water side of the system. Crawford again utilizes a rather complex valving and piping network to achieve this highly desirous result which is expensive and difficult to maintain.

In both the Robinson and Crawford systems, entire sections of the system are closed off or isolated when the system mode of operation is changed. Varying amounts of refrigerant are thus trapped in the isolated sections seriously effecting the actual amount of refrigerant that might be available during any operational mode. This of course creates serious refrigeration management problems that are difficult to overcome. Furthermore, because of the number of valves that must be cycled during each mode change, the control equipment required to regulate the system is also correspondingly complex and expensive.

In co-pending application Ser. No. 017,167 filed Feb. 20, 1987, U.S. Pat. No. 4,727,727, in the name of Reedy which is assigned to the present assignee, there is disclosed an integrated heat pump system which like Crawford can selectively deliver six separate modes of operation. However, unlike Crawford, this improved system can achieve mode changes employing only two additional control valves and a minimum amount of additional piping. In the improved system, all the refrigerant flow sections are arranged so that they are always exposed to the inlet side of the heat pump compressor regardless of the mode of operation that is being used. As a result, the refrigerant in any unused section is drawn into the compressor and rerouted through the active sections thus providing for total utilization of the refrigerant and thus avoiding the refrigerant management problems found in other similar type systems.

As will be explained in greater detail below, the present integrated heat pump improves upon Reedy by further eliminating unnecessary valves and piping circuits without sacrificing any of the advantages found in Reedy.

SUMMARY OF THE INVENTION

It is therefore an object of the present invention to improve integrated heat pump systems.

It is a further object of the present invention to eliminate unnecessary control valves and piping circuits from an integrated heat pump and hot water system.

A still further object of the present invention is to simplify the controls utilized in an integrated heat pump and hot water system.

Another object of the present invention is to eliminate refrigerant management problems in an integrated heat pump and water system capable of delivering multiple operational modes.

These and other objects of the present invention are attained by an integrated heat pump and hot water system that includes a heat pump having an indoor heat exchanger and an outdoor heat exchanger that are selectively connected to the inlet and outlet sides of a compressor by a flow reversing device and to each other by a liquid exchange line. A bi-flow expansion valve having a positive shut off feature is operatively connected into the liquid line. A refrigerant to water heat exchanger is also contained in the system that has a water flow circuit which is placed in heat transfer relation with a first refrigerant condensing circuit and a second refrigerant evaporating circuit. The refrigerant condensing circuit is connected into the discharge line of the compressor upstream from the flow reversing device. The refrigerant evaporating circuit is connected at one end to the inlet line of the compressor and at the other end to an evaporator line that enters the liquid line at some point between the bi-flow valve and the outdoor heat exchanger. A solenoid actuated metering valve is operatively mounted within the evaporator line which is moveable between a first fully closed position whereby refrigerant is prevented from moving through the evaporator line and an open position whereby refrigerant entering the evaporator line from the liquid line is throttled into the evaporator circuit of the refrigerant to water heat exchanger. A controller is utilized to selectively cycle the metering valve, the bi-flow expansion valve, and the reversing valve to provide six different modes of operation that include comfort air heating and cooling with or without hot water heating, hot water heating without comfort air cooling or heating and a defrost cycle wherein energy stored in the hot water side of the system is used to rapidly defrost the outdoor heat exchanger of the system.

BRIEF DESCRIPTION OF THE DRAWING

For a better understanding of these and further features of the present invention reference is herein made to the following detailed description of the invention which is to be read in conjunction with the accompanying drawing which is a diagramatic representation of an integrated heat pump and hot water system embodying the teachings of the present invention.

DESCRIPTION OF THE INVENTION

Referring now to the drawing, there is shown a heat pump of conventional design which is generally referenced 10. The heat pump includes a refrigerant compressor 12 of any suitable design capable of pumping refrigerant at a desired operating temperature and pressure through the heat pump side of the system. The discharge line 13 and the primary suction line 14 of the compressor are connected to a four-way reversing valve 15. The reversing valve, in turn, is connected to one side of an indoor fan coil unit 17 and an outdoor fan coil unit 18. The opposite sides of the two fan coil units are interconnected by means of a liquid refrigerant line 20 to close the heat pump flow loop. A bi-flow expansion valve 21 having an electrically operated positive shut off mechanism associated therewith is operatively connected into the liquid line. When in an open position, the bi-flow valve is capable of throttling liquid refrigerant moving in either direction between the fan coil units. The positive shut off feature associated with the valve permits the valve to be electrically shut down to prevent refrigerant from passing therethrough. With the bi-flow valve in an operative or open position, the function of the indoor heat exchanger 17 can be reversed by simply cycling the position of the four-way reversing valve to provide either heating or cooling to an indoor comfort zone 24. Bi-flow expansion valves of the type herein used are commercially available through Fuji Koki of Japan and are sometimes referred to as stepper motor expansion valves.

The indoor and outdoor fan coil units are both provided with a motor driven fan 22 and 23, respectively, which is adapted to forced air over the heat exchanger surfaces thereby causing energy to be exchanged between the refrigerant and the surrounding ambient. It should be understood that the indoor fan coil unit is typically situated within an enclosed region that is being conditioned and the outdoor fan coil unit is remotely situated typically in an outdoor region.

To provide heating to the comfort zone, the four-way reversing valve 15 is cycled to connect the discharge line 13 of the compressor to the indoor fan coil unit so that high temperature refrigerant leaving the compressor is condensed in the indoor fan coil unit whereupon heat is rejected into the comfort zone. The outdoor fan coil unit at this time operates as the evaporator in the system so that heat from the surrounding outdoor ambient is acquired to evaporate the refrigerant prior to its being returned to the compressor via the primary suction line 14. Cooling is provided to the comfort zone by simply recycling the four-way valve thereby reversing the function of the two fan coil heat exchange units.

A muffler 26 may be placed in the discharge line 13 of the compressor to suppress unwanted compressor noise. An accumulator tank 27 may also be placed in the compressor suction line to collect liquid refrigerant as it is being returned to the compressor.

A refrigerant to water heat exchanger, generally depicted at 30 is placed in the system and permits energy to be exchanged between the heat pump 10 and a domestic hot water system, generally referenced 32. The domestic hot water system includes a conventional hot water holding tank 35 having an upper water storage area 36 and a lower heating unit 37 which can be selectively activated by a thermostatic control (not shown) to provide heat energy to the water stored in the tank. Water is supplied to the storage tank from an outside source by means of an inlet line 38 and is drawn from the tank on demand by means of an outlet line 39. As will be explained in greater detail below, the water tank heater is typically held inactive any time that the heat pump is operating so that the entire heating load of the hot water system is supplied by the heat pump. Typically, the stored water is heated to a temperature of between 120 degrees F. and 140 degrees F.

Heat exchanger 30 contains three flow circuits that are placed in heat transfer relationship with one another so that energy can be exchanged. The three circuits include a water circuit 40, a first refrigerant condensing circuit 41, and a second refrigerant evaporating circuit 42. The water circuit is connected in series with the domestic hot water storage tank by means of a water line 45 that forms a circulating loop between the tank and the water circuit 40. The circulating pump 46 is connected into the water line and is electrically actuated by an electrical controller 50.

The first refrigerant flow circuit, the refrigerant condenser circuit 41, is connected into the discharge line of the compressor between the compressor outlet and the four-way reversing valve 15. When the heat pump is in operation, high temperature refrigerant leaving the compressor is passed through the refrigerant condensing circuit 41 of heat exchanger 30 and will be therefore available to provide energy into the hot water side of the system.

The second refrigerant circuit, the evaporator flow circuit 42, is connected in series between the suction side of the compressor via a secondary suction line 51 and an expansion line 52. The expansion line, in turn, is connected at one end to the inlet of the evaporator circuit and at the other end to the liquid line 20 at a point somewhere between the bi-flow expansion valve and the outdoor heat exchanger. A solenoid actuated metering valve 55 is operatively connected into the expansion line. This type of commercially available valve is known and used in the art. The metering valve along with the four-way reversing valve, the motor of the outdoor fan unit, the motor of the indoor fan unit, the bi-flow expansion valve, and the water pump are all electrically wired to the controller 50 as shown in FIG. 1 so that each of the devices can be selectively cycled depending upon the mode of operation selected.

Valve 55 is normally closed to prevent refrigerant from moving through the evaporator line 52 and thereby removing the evaporator circuit 42 from the system. When its solenoid is energized valve 55 opens and refrigerant is permitted to move through the evaporating line. The refrigerant is throttled as it passes through the valve and enters the evaporator circuit of the refrigerant to water heat exchanger. In the evaporator circuit, heat energy is rejected from the hot water side of the system into the refrigerant to evaporate the refrigerant prior to its being delivered to the inlet of the compressor via the secondary inlet line 51.

Air Conditioning With or Without Hot Water Heating

During normal air conditioning (heating or cooling) operations, the bi-flow expansion valve 21 is opened by the control unit and at the same time metering valve 55 is closed. Both fans 22 and 23 are placed in an operative or on position and refrigerant is routed through the heat pump to provide either heating or cooling to the comfort zone in response to the positioning of the reversing valve 15. The control unit is adapted to periodically turn on the water pump 46 to circulate water from the holding tank 35 through the water loop when water heating is required. By design, part of the heat contained in the refrigerant vapor leaving the compressor is transferred into the water as it is being circulated through the water loop. The remaining energy in the refrigerant is passed on to one of the fan coil units where the refrigerant is fully condensed to a saturated liquid. The energy in the compressor discharge flow is thus available for both heating water in the water side of the system and to satisfy the heating or cooling demands of the heat pump. The amount of energy exchanged is a function of the available heat transfer surface area, the flow rates of the working substances, and the amount of work that the heat pump is called upon to perform during selected heating or cooling operations.

Water Heating Without Air Conditioning

In the event additional hot water is required during periods when comfort air conditioning is not required, fan 22 of the indoor fan coil unit is turned to an inactive or off position to prevent energy from being exchanged between the refrigerant and comfort zone ambient. The bi-flow expansion valve 21 is held open by the control unit and metering valve 55 remains closed. The water pump is turned on as explained above and the reversing valve 15 is cycled to the heating mode of operation.

In this configuration, the refrigerant to water heat exchanger acts as a full condenser and water is permitted to remove as much energy from the refrigerant as needed to satisfy the demands placed on the hot water system. Although not shown, a hot water thermostat may be used to sense the water temperature in the storage tank and shut down the system when a desired storage water temperature of between 120 degrees F. and 140 degrees F. is attained.

Outdoor Defrost Cycle

The apparatus of the present invention includes a novel defrost cycle which utilizes the hot water available in storage tank 35 to efficiently defrost the outdoor fan coil during periodic defrost cycles without producing the "cold flow" generally associated with many other heat pump systems. When in a heat mode of operation the outdoor fan coil acts as an evaporator, and as a result, the coil surface of the outdoor unit becomes coated with frost or ice. Normally, when the outdoor coil of a conventional heat pump becomes frosted, the system is switched to a cooling mode wherein the outdoor coil acts as a condenser to remove the frost buildup. At the same time, the indoor coil acts as a refrigerant evaporator to provide cooling to the comfort zone. Unwanted cool air is thus blown into the comfort zone. In order to offset the cooling effect, electrical strip heaters are sometimes placed in the air duct that conducts conditioned air over the indoor coil. The heaters are arranged to come on when a defrost cycle is initiated and are turned off when the cycle is terminated. As is well known in the art, reversing the heat pump cycle and utilizing electrical strip heaters is highly inefficient and increases the cost of operating the heat pump.

In the present integrated system, the previously heated water, which is stored in the tank at between 120 degrees F. and 140 degrees F., is used to provide energy to the refrigerant during a defrost cycle. To utilize this relatively inexpensive and readily available energy in a defrost cycle, the present heat pump is placed in a cooling mode by the control unit, outdoor fan motor 23 is turned off, bi-flow valve 21 is shut down and valve 55 is opened. At the same time, water pump 46 is cycled on. Accordingly, the refrigerant to water heat exchanger 30 now serves as the evaporator on the refrigerant side of the system. High temperature refrigerant discharged by the compressor is delivered to the outdoor coil where the heat of condensation is used to remove any ice or frost that might be present on the coil surfaces. Upon leaving the outdoor coil, the refrigerant is throttled through the metering valve 55 and passed through the evaporating circuit 42 in heat exchanger 30. In the exchanger, the refrigerant absorbs sufficient heat from the circulating hot water to evaporate the refrigerant. Refrigerant vapor leaving the heat exchanger is drawn into the suction side of the compressor via the secondary suction line 51 that joins the primary suction line 14 at the entrance 61 to the accumulator.

As can be seen, use of the defrost cycle eliminates the need for inefficient strip heaters and, because the indoor coil is taken out of the cycle, there is no objectional cold air blown into the comfort zone during the defrosting operation. Although energy is taken out of the hot water side of the system during the defrost cycle, this energy is eventually replaced at little cost when the heat pump is returned to a normal heating mode. This is achieved by simply allowing the water pump to continue to run until such time as the water supply once again reaches a desired storage temperature.

The integrated system of the present invention, through use of only one additional control valve, is capable of delivering six different operational modes. These include heating with or without water heating, cooling with or without water heating, heating of water without air conditioning, and a novel defrost cycle which efficiently uses energy stored in the hot water side of the system to evaporate refrigerant. It should be further noted that in all configurations the suction side of the compressor is connected to the refrigerant sections that are used in a selected operational mode. The compressor thus serves to remove refrigerant from isolated circuits and, accordingly, refrigerant management and inventory problems generally found in other integrated systems are avoided.

While this invention has been described with respect to certain preferred embodiments, it should be recognized that the invention is not limited to those embodiments, and many variations and modifications would be apparent to those of skill in the art without departing from the scope and spirit of the invention, as defined in the appended claims.

What is claimed is:

1. An integrated heat pump and hot water system that includes, a heat pump having an indoor heat exchanger unit and an outdoor heat exchanger unit that are selectively connected to a compressor inlet and a compressor outlet by a flow reversing means and to each other by a refrigerant liquid line containing a bi-flow expansion valve for metering refrigerant moving in either direction through the liquid line, said bi-flow expansion valve having a positive shut off means to prevent refrigerant from flowing therethrough, a refrigerant to water heat exchanger having a water flow circuit that is in heat transfer relation with a first refrigerant condensing circuit and a second refrigerant evaporating circuit, said refrigerant condensing circuit being connected into a discharge line connecting the outlet of the compressor to the reversing means whereby all refrigerant discharged by the compressor passes through said condensing circuit, said refrigerant evaporating circuit being connected at one end to the inlet of the compressor and at the other end to an evaporator line that is operatively joined to the liquid line at a point between the bi-flow expansion valve and the outdoor heat exchanger, a metering valve in the evaporator line that is selectively movable between a first closed position whereby refrigerant is prevented from moving through the evaporator line and an open position whereby refrigerant is throttled from the liquid line into the evaporator circuit, and control means for cycling the metering valve and the bi-flow expansion valve.

2. The integrated heat pump of claim 1 wherein the control means is arranged to cycle the reversing means to change the heat pump from a cooling to a heating mode of operation.

3. The integrated heat pump of claim 2 wherein said indoor heat exchanger includes a fan for moving air over heat exchanger surfaces and the control means is arranged to selectively turn the indoor fan on and off in response to the selected mode of operation.

4. The integrated heat pump of claim 1 wherein said metering valve is a solenoid actuated valve.

5. The integrated circuit of claim 1 wherein said water circuit is connected to a water line for circulating water from a storage tank through said water circuit.

6. The integrated circuit of claim 5 that further includes a pump in the water line that is cycled on and off by the control means in regard to the mode of operation selected.

* * * * *